United States Patent [19]

Weihrauch

[11] Patent Number: 4,893,876

[45] Date of Patent: Jan. 16, 1990

[54] PROCESS AND APPARATUS FOR PRODUCING BRISTLE ARTICLES AND USE OF THE PROCESS FOR IMPLEMENTS HAVING A SIMILAR CONSTRUCTION

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 204,735

[22] Filed: Jun. 10, 1988

[30] Foreign Application Priority Data

Jun. 13, 1987 [DE] Fed. Rep. of Germany ..... 3719823

[51] Int. Cl.[4] ..... A46D 1/00

[52] U.S. Cl. ..... 300/8; 300/21

[58] Field of Search ..... 300/2–11, 300/21; 264/243

[56] References Cited

FOREIGN PATENT DOCUMENTS 439274 9/1948 Italy ..... 300/21

527237 10/1940 United Kingdom ..... 300/21

588576 5/1947 United Kingdom ..... 300/21

*Primary Examiner*—Mark Rosenbaum

*Attorney, Agent, or Firm*—Antonelli, Terry & Wands

[57] ABSTRACT

Bristle articles, such as brushes, brooms, paintbrushes, combs, mats, etc., comprise a bristle carrier and bristles combined into bundles and joined thereto and which are arranged in the form of several spaced rows. Such a bristle article is produced in that a bristle section is provided in a length, which essentially constitutes the length required for all the bristles of a row, plus the length resulting from the sum of the spacings of the bristles in a row. Accompanied by corresponding shortening of the bristle section, from the latter loops are formed at each bristle position, are drawn in a spacing corresponding to the spacing of the bristles in the row and then all the loops are fixed by one of their ends simultaneously to the bristle carrier, whilst they are optionally cut at the opposite end.

38 Claims, 4 Drawing Sheets

37
38
32
22
24
21
23
40
39
41
42
33
43
44
50
46
48
49
47
45
36
20
35
34
1
2
3
4
5
6
7
8
9
10
11

PROCESS AND APPARATUS FOR PRODUCING BRISTLE ARTICLES AND USE OF THE PROCESS FOR IMPLEMENTS HAVING A SIMILAR CONSTRUCTION

BACKGROUND OF THE INVENTION

The invention relates to a process for the production of bristle articles, such as brushes, brooms, paintbrushes, combs, mats, etc., which comprises a bristle carrier and bristles, optionally combined into bundles and connected thereto, whereof a plurality bristles are arranged in a spaced manner in at least one row, in that a bristle section is transformed by means of a drawing tool into a double layer and accompanied by the formation of a loop and the loop is fixed with one of its ends to the carrier. The invention also relates to an apparatus for performing the process and to the use of the process and/or apparatus for producing implements of a similar construction.

The production of bristle articles has reached a high technological standard as regards the working speed, but the production of the individual bristles or bristle bundles and their supply to the bristle carrier has remained virtually unchanged for decades, as has the connection of the bristles and bristle carrier, to the extent that mechanical connections are involved. Reference will firstly be made to known connecting or joining processes. In the case of mechanical fixing the wooded plastic or similar bristle carrier has a number of holes corresponding to the number of bristle bundles and into these the latter are wedged, vibrated in, bonded in or anchored by means of a metal anchor as a loop. Processes and apparatuses following this principle already operate at high speeds, because the fixing generally only requires one tool stroke (e.g. DE-AS 1 049 823 and German Patent No. 618 031).

Modern plastic technology has lead in particular over the past few years to the development of processes and apparatuses, with which plastic bristles can be joined together in the plasticized state on a plastic bristle carrier. In the case of a corresponding affinity of the plastics, welding processes are used or the bristle ends are embedded in the soft plastic material of the bristle carrier (e.g. U.S. Pat. No. 4 132 449). The fastening-side ends of the bristles are also melted, so that they are welded together, a thickened portion is optionally formed and then they are pressed onto the carrier which is at least zonally melted on its bristle side. It is finally known in connection with the production of the bristle carrier, e.g. by injection moulding (e.g. U.S. Pat. No. 2 655 409) or foaming to embed the bristles in moulds, in that the bristles or bristle bundles, whose fastening-side end has possibly been previously melted and converted into a thickened portion, are placed in the mould and subsequently the bristle carrier is moulded. Thus, in this case the bristles or bristle bundles are embedded in the carrier material. The latter process and also thermal processes generally lead to a completely satisfactory product from the use standpoint, because the bristle carrier has no holes, or at least no open holes and the bristle bundles terminate cleanly with the bristle carrier side, so that such bristle articles are in particular satisfactory hygienically. In addition, the bristles generally have a higher extraction resistance.

When process natural bristles, it is necessary as a result of the relatively short length thereof to use in the bristle carrier individual blanks corresponding to the bristle length, plus the anchoring length. If the bristle bundle is formed by a loop fixed by means of its camber or bend-round to the bristle carrier, the blanks correspondingly have roughly twice the length. This so-called short-cut technology was subsequently adopted when processing plastic bristles, which are generally produced by extrusion. The extruded monofilaments are brought together to form a bundle strand and then the blanks are cut to length therefrom.

The shaping and supply of individual bristles to the bristle carrier essentially takes place by two methods. If the blank produced has the final diameter of the bristle bundle, then e.g. the cut to length bristles are housed in a magazine in parallel form as a larger group. The magazine is constructed as a parallepipedic container and has in its one wall an opening, into which can be introduced a cutout tube, whose internal diameter corresponds to the external diameter of the bristle bundle and by means of which a bundle can be cut out. Using the cutout tubes the bundles are supplied to the bristle carrier, joined thereto and the cutout tube is retracted (e.g. DE-OS 2 849 510, GB-OS 2 016 917). This process is mainly used for welding the bristles to the bristle carrier, but suffers from a number of disadvantages. It only functions in the case of bristles above a certain diameter, which guarantees the necessary transverse stability of the bristles and also only as from a certain bristle length. However, on cutting out bending and tilting of the bristles occurs in the magazine and this leads to operating problems during the subsequent cutout cycles. If the cutout tube is not completely filled, then bristle bundles or individual bristles can fall out on transfer to the bristle carrier. On discharging the bristles from the cutout tube, frequently individual bristles remain stuck in the tube and during the subsequent cutout operation they need to operational problems. In a similar procedure used in conjunction with welding and injection moulding, the bristles of a bundle are melted at their end to form a thickened portion and the individual bundles are conveyed in lines pneumatically in much the same way as a pneumatic tube, the thickened portion intending to ensure the sealing in the line. However, this process is extremely fault-prone and has not been adopted in practise (EP-OS 0 149 996).

In the method of DE-AS 1 049 823, the bristle blank is mounted on a draw-in tool at right angles to its final position on the bristle carrier. In the centre of the support, the tool has a draw-in opening, which is aligned with the fastening point of the corresponding bristle bundle on the bristle carrier. By means of a drawing tool moving from above to the bristle blank, e.g. in the form of a tongue, the blank is drawn into the draw-in opening accompanied by the formation of a loop until its leading camber passes out at the opposite side of the draw-in tool. By means of this end the bristle bundle is then mechanically fixed to the bristle carrier, in that e.g. it is driven into a hole on the bristle carrier by an anchor carried by the tongue or it is vibrated into the hole. Thermal joining processes or embedding processes are also possible in this way.

For some time plastic bristles have been available, which can be wound up in the form of an endless strand and numerous attempts have been made to carry out processing directly from the roll or spool. The basis for this is either provided by monofilament endless strands, which are in each case placed on a roll (U.S. Pat. Nos. 2 655 409 and 2 710 774). These monofilaments must firstly be combined to a bundle and then the bundle is cut to bristle length or double the bristle length during loop formation and finally the individual bundles are supplied by one of the aforementioned processes to the bristle carrier. For both space and operation reasons this method is only usable for those bristle articles having a relatively small number of bristle bundles, because it is necessary to have for each bristle bundle a plurality of rolls with guide and removal means and all the monofilaments must be brought together on a small diameter. This process is unsuccessful in the case of brooms, hand brushes, etc. These problems can be reduced although not eliminated, if bundle strands and not monofilaments are wound onto the roll, so that only one roll is required for each bristle bundle (DE-AS 1 049 823 and U.S. Pat. No. 4 132 449). However, as a result of the roll diameter, the inadequate creep strength of plastics and the tensile forces required during winding, length differences occur within the bundle, which are extremely disadvantageous during processing. Attempts have already been made to avoid or compensate these length differences, in that monofilaments are twisted within the bundle strand, optionally the strand is wound by the cross-winding process and finally processing takes place under an increased tensile force in order to bring the shorter filaments, by expansion, to the same length as the longer monofilaments. Here again the problem occurs that in the case of a bristle article with a plurality of bundles, e.g. from brooms, scrubbing brushes, mats, etc., a separate roll must be provided for each bundle. This is not very practicable and is uneconomic due to the costs for the rolls, the necessary space requirements and the bundle supply problems.

SUMMARY OF THE INVENTION

The problem of the present invention is to propose a process with the aid of which a plurality of bristles or bristle bundles can be rapidly brought into a position and associated with one another, which corresponds to the final position on the finished bristle article. It must in particular be possible to process the bristles as an endless strand from the roll and to reduce the number of rolls necessary for a bristle coverage.

According to the invention this problem is solved in that the bristle section is made available in a length, which roughly corresponds to the length required for all the bristles in a row, plus a length resulting from the sum of all the spacings of the bristles in a row, whereby subsequently all the loops are drawn out of the bristle section, accompanied by a corresponding shortening of the bristle section and simultaneously fixed by their ends to the bristle carrier.

The bristles or bristle bundles are arranged on the bristle carrier generally in parallel longitudinal and transverse rows. There can optionally be a displacement between the individual rows. If the coverage surface differs from a rectangular surface, e.g. in the case of bristle articles with an oval or circular contour, bundle rows can be formed, which optionally differ from a linear configuration. Independently of the precise course of the bundle row, it is possible with the inventive process to make available and position all the bundles for such a row in a very short time in that a bristle section of correspondingly large lengths is produced and from this section are simultaneously or successively produced from said section a number of loops corresponding to the number of bundles. Thus, unlike hitherto, it is not necessary to produce blanks corresponding to the length required for a bristle bundle and then shaped each individual blank to a loop. The working time for forming all the loops of a row is consequently greatly reduced. This process can be used for any random manner of fixing the bristles to the bristle carrier. There are neither space nor supply problems, because now it is possible to produce the bundles of a complete bristle row from a single roll, which contains a corresponding endless bundle strand. In the case of the inventive process, as a result of the limited space requirements, it would even be possible to process monofilaments from several rolls and to combine them into a bundle strand immediately prior to loop formation.

Generally the process is performed in such a way that each loop forms a bundle of finished bristles article. However, instead of this, it can be provided that each loop is drawn in a width corresponding to the spacing of adjacent bristles in a row, so that a bristle bundle is then formed by each of the two sections of a loop.

Preferably initially a first loop is drawn from the bristle section, accompanied by a corresponding shortening of the said section and then in a spacing roughly corresponding to the spacing of the bristles in the row, the next and successively all the other loops are formed, whilst drawing in each case necessary lengths of bristle section. The formation of a loop is started, whose length requirement is drawn from the bristle section. When the loop has reached its end position, the next loop is formed until all the loops needed for a bristle row are formed.

According to a further construction the bristle section is drawn from an endless strand wound onto a roll in a length roughly corresponding to the length of a bristle row, is secured at a free end and the loops are formed whilst removing the necessary length from a roll. The first loop can be formed in the vicinity of the secured end of the endless strand, whilst removing the necessary length from the roll and then successively the other loops can be formed in the direction of the roll, whilst removing the necessary length from it.

In this process variant the length required for forming the bristle section is drawn from the roll. Throughout loop formation this section remains joined to the endless strand on the roll and the length required for loop formation is removed from the roll as loop formation progresses. The endless strand on the roll can once again be formed as a bundle strand, but it is also possible for several rolls to be provided with in each case one monofilament and then the monofilaments are combined to give the bristle section. The formation of the loops starts in the vicinity of the free end of the endless strand and advances in the direction of the rolls. It is merely necessary to ensure that the bristle section prepared for loop formation is under a certain tensile force, so that the bristle section is always slightly tensioned. This can be brought about in simple manner in that unwinding is possible whilst there is a corresponding resistance on the roll and this is e.g. produced by a brake or the like.

According to another process variant the bristle section can be prepared as a blank with the length required for the complete bristle row, plus the sum of the spacings between the bristles of said row and the bristles can be formed whilst drawing the necessary length from at least one end of the bristle section. The blank can be secured at one end and then the loops can be successively formed passing from one end of the section to the other. Instead of this, the blank can also be resiliently held at both ends and the loops can be formed in the direction of both ends starting from the centre.

Such a blank can either be produced from a roll arranged direction at the processing point by cutting to length, or can be prepared at another point and brought to the processing point. Working from the centre leads to the additional advantage that the working speed can be approximately reduced by half, because two loops are simultaneously formed on either side of the central loop. The necessary length is in this case taken from the two free ends of the blank.

It is also pointed out that the process variant in which the necessary length is obtained by drawing from the roll can be combined with the other process variant where a blank of corresponding length is prepared, in that e.g. a bristle section is produced, whose length roughly corresponds to half the total length requirement and the formation of the loops starts in a central position and advances to either side, the length being drawn on one side from the free end and on the other side from the roll. It is also possible to work with facing rolls and to in each case produce half the length of the bristle section from each roll and here again the loops are formed from the centre.

In a further development of the aforementioned process variants, it is possible to join the loops to the carrier at their camber formed during drawing and to cut up the section formed into loops in each case between the latter, so that the useful side-end for each bristle bundle is obtained. However, in place of this, it is also possible to leave the camber and to cut up the section formed into loops between the latter and to join the resulting ends to the carrier, so that there are loops and not free bristle ends at the useful side, which can be desired for certain uses. Naturally the chamber could be cut off and consequently free bristle ends would be obtained.

The inventive process also offers the possibility of not only bringing the individual loops into the position necessary for their subsequent application to the bristle carrier, but also into the position assumed by the bristle bundles opposite to the carrier. Even though in general the bristles are parallel to one another, so that the loops are drawn parallel to one another, it is also possible to draw the loops in an angular position corresponding to the angular position of the bristles on the finished bristle article. This differing positioning of the bristle bundles with respect to the bristle carrier can be realised without difficulty at the time of loop formation using the inventive process.

As has already been indicated, there is no need for the bristle row to be linear and in the case of a bristle displacement there can optionally be a multiply angled or wavy line in which the loops are positioned.

If the finished bristle article has more than one bristle row and the latter is successively covered or occupied according to the invention, a further process variant is characterized in that there are three juxtaposed working planes and that the loops are formed in the central working plane, whereas alternately in the other planes the bristle section is produced in the necessary length and following the joining of the bristles to the carrier is brought into the central plane.

Thus, a bristle section can be alternately prepared in one of the two working planes beside the central working plane, whilst simultaneously in the central working plane the bristle section located there is formed into loops. Thus, the cycle time required for the preparation of the bristle section and loop formation is subdivided into two steps, i.e. the cycle time is correspondingly reduced and the supply of the bristle section is made easier. The bristle carrier can be moved in timed manner at right angles to the two working planes, in order to successively form a bristle row. On working from a roll with endless strands, a roll is associated with the central working plane and one of the two other planes, the roll being moved between the central and one of the other two working planes.

It is naturally also possible in place of this to provide a corresponding number of bristle sections in the case of a bristle article with several rows of bristles and simultaneously draw the loops for all the aligned bristles at right angles to the rows, so that all the bristles or bristle bundles for covering a brush or the like are brought into position in a single operation. This process is particularly advantageous when the bristles are fixed by a thermal process or by embedding (injection moulding or foaming the bristle carrier).

For performing the process, the invention makes use of an apparatus with a bristle draw-in tool, which has on its top a receptacle for a bristle section and at least one draw-in opening at right angles thereto and a drawing tool aligned with the draw-in opening and moveable in said direction, which grips the bristle section located in the receptacle, draws it into the draw-in opening as a double layer and accompanied by the formation of a loop, until the loop projects with its camber over the opposite side of the plate, as well as with a device for joining the loop with a carrier of the bristle article to be produced.

In the case of such a known apparatus, the problem of the invention is solved in that the draw-in tool has a plurality of draw-in openings, which are arranged in a row and with a spacing corresponding to the spacing of the bristles on the finished bristle article and has a receptacle for a correspondingly long bristle section engaging over all the draw-in openings and that a plurality of drawing tools corresponding to the number of draw-in openings is provided, said tools are being aligned with said openings. The drawing tools can simultaneously and in time succeeding manner in the sequence of their arrangement can draw the loops into the draw-in openings, whilst suplying in each case a corresponding bristle section length.

If the loops are successively formed, then the draw-in openings in the draw-in tool have a cross-section which is slightly larger than the cross-section of the bristles or bundles, so that there is adequate space for the drawing tool. The bristle section located on the draw-in tool receptacle and which is optionally constructed as a correspondingly long blank or part of an endless strand located on a roll, is successively drawn into the draw-in opening until the camber of the loops project from the opposite side of the draw-in tool. The extent of the loop camber projection of the underside of the tool is dependent on whether it is the useful side-end (theoretically in this case there is no need for a projection, unless the camber is cut off), or is used for fixing the bristles. Thus, both in the case of thermal fixing processes (welding or pressing in) and in the case of embedding processes (injection moulding and foaming) such a projection will be chosen so as to permit the melting of the camber, the welding together of the bristles and optionally the formation of a thickened portion at the bristle ends. In the case of the embedding process (injection moulding and foaming), the camber can optionally be directly used for embedding, in that the material of the bristle carrier flows behind the camber and the bristles are anchored in this way. If the loop projection is made correspondingly large, then the camber is widened directly behind the draw-in openings due to the recovery capacity of the bristles, so that on embedding in the carrier material a greater quantity can flow behind the loop camber and an even better anchoring can be obtained.

It is naturally also possible to arrange the device for fixing the bristles to the bristle carrier above the draw-in tool, it then merely being ensured that the draw-in tools are moved away following loop formation. In this case, generally the bristle section is centrally cut between the loops formed or is completely cut off by means of a transverse knife and optionally once again thickened portions are formed at the free loop ends by melting. If the camber is retained at the usefulside end, then the draw-in tool must be split along the draw-in openings, in order to be able to remove the bristles from the mould following fixing.

In all the loops are to be drawn simultaneously, then the draw-in tool comprises ledges running at right angles to the bristle section, whereof in each case two form a draw-in opening and can be moved together from a basic position with a spacing which is greater than the width of the loops synchronously with the movement of the drawing tool into an end position, in which their spacing corresponds to the width of the loop. Simultaneously, the pairs of ledges forming in each case one draw-in opening are synchronously movable towards one another whilst reducing their spacing until in their end position the spacing of the draw-in openings formed by them correspond to the spacing of the bristles, whilst simultaneously the drawing tools are moved up at right angles to one another.

Preferably, the draw-in tool forms a guide for a clamping tool arranged in its median longitudinal plane and having corresponding draw-in openings, the clamping tool being displaceable in the guide. Following mould removal of the loops, it is possible in this way to slightly displace the draw-in openings in the clamping tool with respect to those in the guide, so that the bristles are moved tightly together, so that in this way a correspondingly tight bristle bundle is obtained after fixing. In addition, the individual loop is securely fixed by the clamping tool, so that there can be no change to its position during the fixing process. It is simultaneously possible to transfer the draw-in tool with the clamped loops from the station at which the loops are formed to another station, where e.g. fixing can be carried out and consequently once again the cycle time of the installation can be kept short, because the formation of the loops and the fixing in different positions can be carried out simultaneously.

Advantageously the receptacle for the bristle section is constructed as a channel arranged on top of the draw-in tool and its width roughly corresponds to the diameter of the bristle section, so that a completely satisfactory guidance and supporting of the bristle section is ensured.

If an endless strand is processed from the roll, then it is inventively provided that with the draw-in tool is associated a roll containing the bristles as an endless strand and a removal device, by means of which the bristle section can be drawn into the channel to such an extent that the free end is located behind the last draw-in opening in the removal direction, that a holding device for fixing the free end is provided and that initially the drawing tool close to the free end and then the following tools in the direction of the roll come into action and the length required for a loop is drawn from the roll counter to an opposing force keeping the bristle section taut, whilst between the roll and the first draw-in opening is provided a cutting mechanism which comes into action following the end of loop formation.

The roll is preferably arranged in such a way that on the draw-in tool the channel is approximately aligned with a central removal diameter of the roll. Upstream of the channel it is optionally possible to provide a guide, through which the endless strand is drawn into the channel over the final draw-in opening. Downstream of said draw-in opening the bristle section is fixed by a clamping mechanism or the like in the channel, so that in the case of successive feeding in of the drawing tools the length necessary for a loop is in each case removed from the roll. As has already been stated, the roll can be provided with a braking means, so as to keep the bristle section under a pretension during the drawing in of the loops.

However, in the case of preparation from the roll or at another point a bristle section is prepared in the form of a corresponding long blank, then the inventive apparatus is characterized in that the channel of the draw-in tool receives a bristle section in the form of a blank, whose length roughly corresponds to twice the length of all the loops, plus the sum of all the spacing between the loops, that before the first and behind the last draw-in opening is provided a holding down device for the bristle blank and that the drawing tools come into operation starting at the first or last draw-in opening and pass in the direction of the other opening, or start in the centre and simultaneously move to either side.

In the case of this construction, the holding in device, in the manner known from deep-drawing processes, fixes the bristle section upstream of the first and downstream of the last draw-in opening. The holding down force is chosen in such a way that on the formation of the loops, the bristles have to be drawn against a corresponding resistance, so that the bristle section is always adequately tensioned in this area over the draw-in openings.

For cutting the bristle section between the loops, as well as for cutting off the camber, it is possible to arrange corresponding cutting devices above and/or below the draw-in tool.

Preferably the device for joining the loops to the bristle carrier is positioned directly below the draw-in tool and consequently the fixing of the bristles takes place at the same working position as the formation of the loops. However, if it is wished that this takes place at another point, then preferably two or more draw-in tools will be provided, which are moved between the position where the loops are formed and the position where fixing takes place.

If the loops are successively formed for several rows of bristles, then preferably at least two draw-in tools of one draw-in tool with two parallel rows of draw-in openings are provided and the drawing tools are only associated with one row of draw-in openings, whereas in the case of the other row of draw-in openings only the bristle section is placed in the channel and that the draw-in tools are moveable at right angles to the row of drawing tools in a position beside it for inserting the bristle section during loop formation in the central position.

This makes it possible to form loops in one of the positions and to provide in the other position the necessary bristle section. This facilitates the introduction of the bristle section into the draw-in tool channel and also the cycle time is reduced.

On working from the endless strand, a roll with a bristle endless strand is associated with each row of draw-in openings on the draw-in tool, the rolls being moveable with said tool or corresponding strand guides are provided.

It is also possible to provide at each of the two positions beside the drawing tools a fixed removal device, which draws the bristle section into the draw-in tool channel. In this embodiment the bristle carrier can be timed at right angles to the row of drawing tools, in order to successively cover the bristle rows.

As a function of the position of the bristles with respect to the bristle carrier, the draw-in openings can be arranged in parallel or at an angle to one another corresponding to the angular position of the bristles on the finished bristle article. Furthermore the draw-in openings can be arranged on a line following the arrangement of the bristles on the bristle article.

The drawing tools can be positioned above the draw-in tool and are then constructed as tongues moveable from top to bottom. However, it is also possible to arrange the drawing tools below the draw-in tools and construct them in crotchet needle-like manner and are then moveable from a position above the same into a position below it.

If the loops are to be formed for several or for all the bristle rows simultaneously, then according to the invention a draw-in tool has a number of rows of draw-in openings corresponding to the number of bristle rows on the finished bristle article or part thereof, a corresponding number of drawing tool rows is provided and the drawing tool aligned at right angles to the rows are synchronously driven or arranged on a common carrier.

Thus, in this way, several bristle rows or all the bristle rows of the finished bristle article can be processed simultaneously, in that corresponding rows of loops are formed. If only part of the bristle rows is prepared in this way, then after fixing to the bristle carrier, the latter is then timed on the still empty positions and completely occupied. This apparatus can be modified in such a way that e.g. a row of drawing tools is only associated with every other row of draw-in openings and the draw-in tool, following the formation of the corresponding loop rows, is moved by one position at right angles, so that then once again empty draw-in openings are located in the position of the drawing tools and subsequently the loops are drawn into said openings. It would obviously be possible to provide drawing tools only for every third row or the like, which then requires a corresponding number of transverse timed cycles.

The inventive process and apparatus can be used in equally advantageous manner in the production of those implements which, instead of bristles, have textile strips or threads fixed to a carrier. A particular example of such implements consists of mops.

BRIEF DESCRIPTION OF DRAWINGS

The invention is described in greater detail hereinafter relative to two embodiments and the attached drawings, wherein show.

DETAILED DESCRIPTION OF THE PREFERRED EMBODIMENTS

Figures 1, 2:
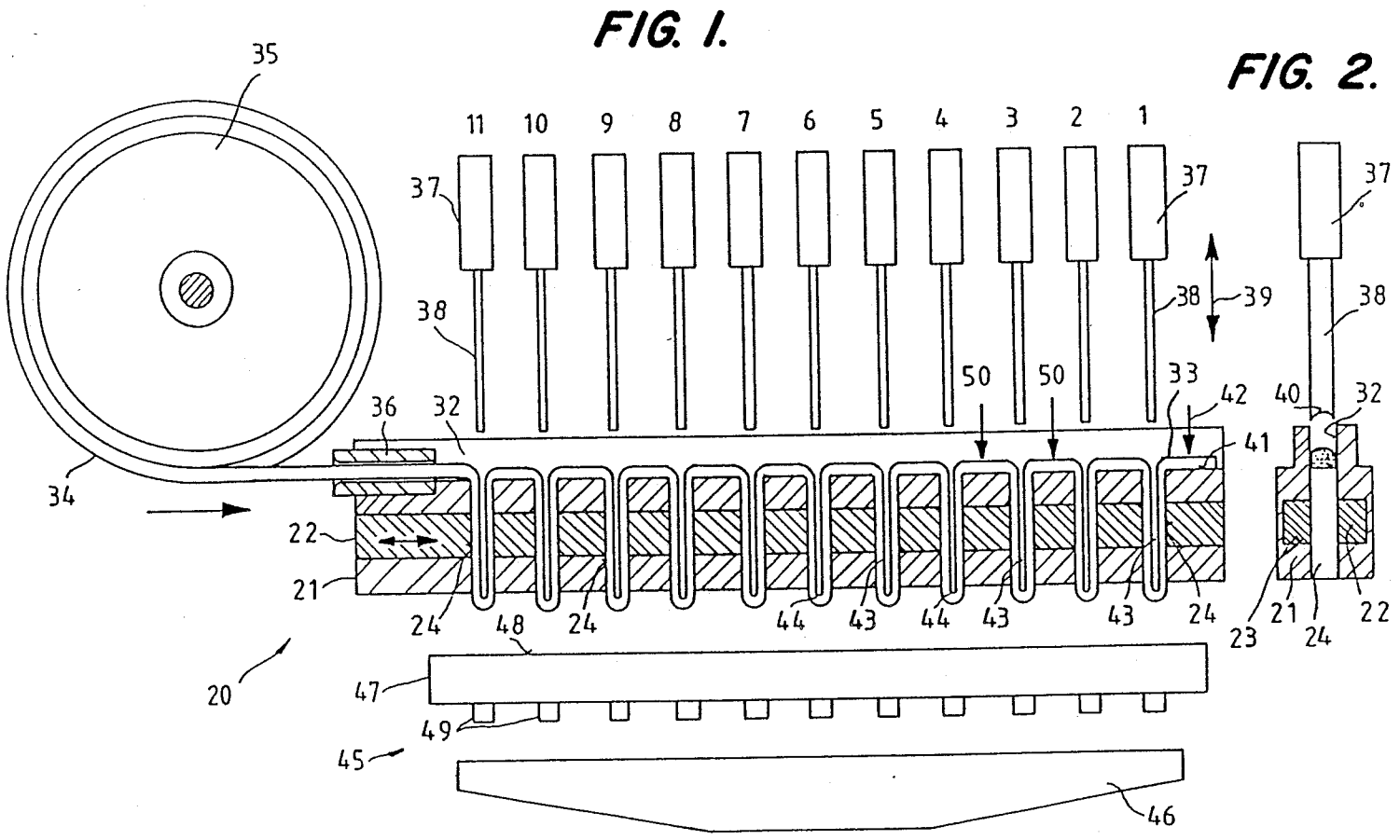
FIG. 1 a diagrammatic side view of a first embodiment of the apparatus.
FIG. 2 a cross-section relative to FIG. 1.
Figure 3:
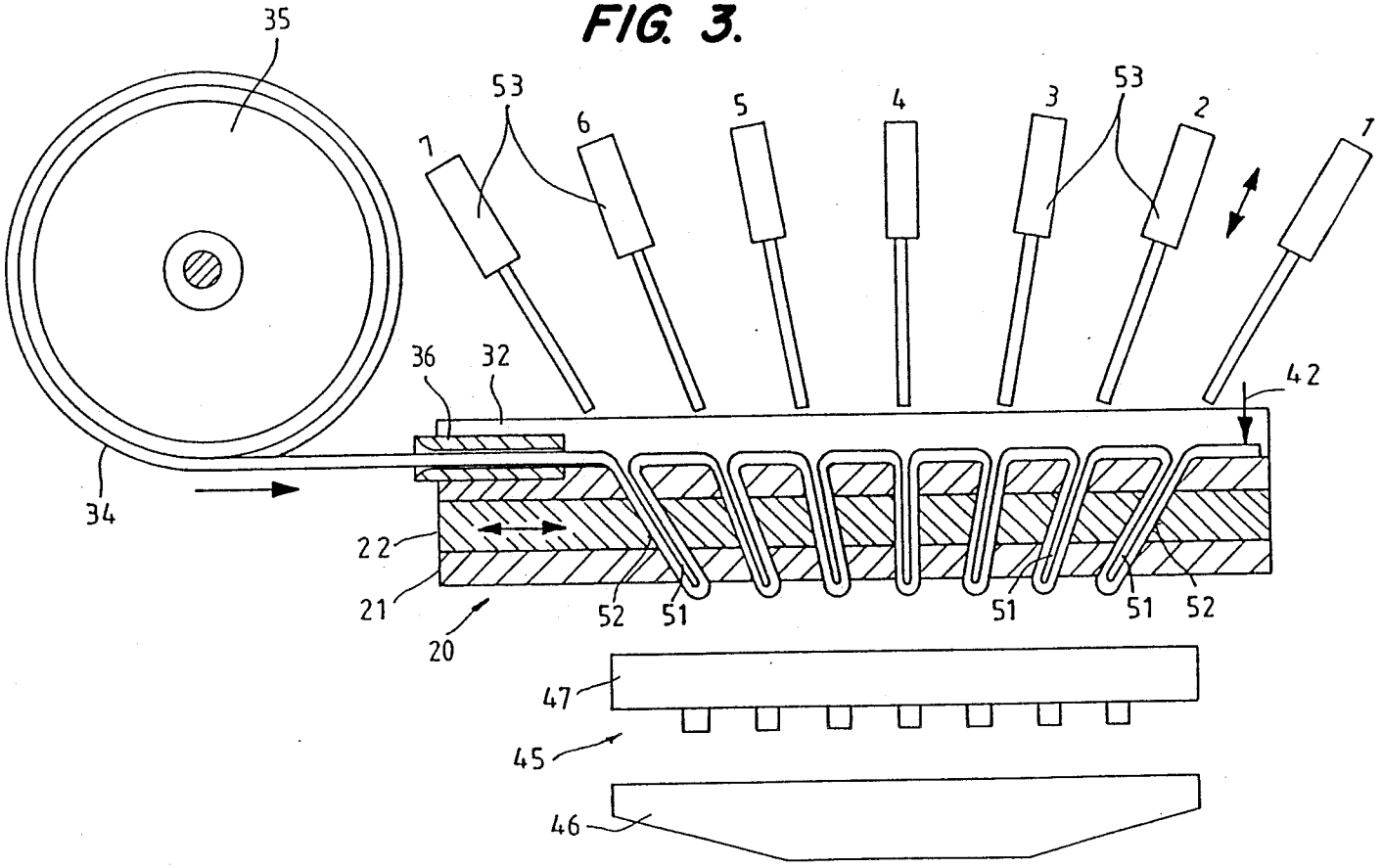
FIG. 3 a diagrammatic view of another embodiment of the apparatus.
Figure 4:
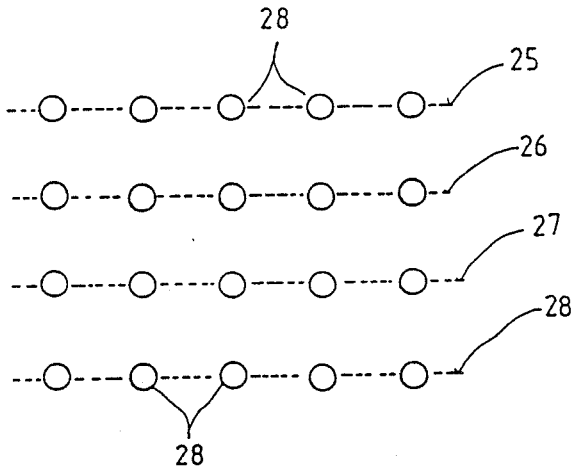
FIG. 4 a diagrammatic view of a bristle coverage surface of a bristle article.
Figure 5:
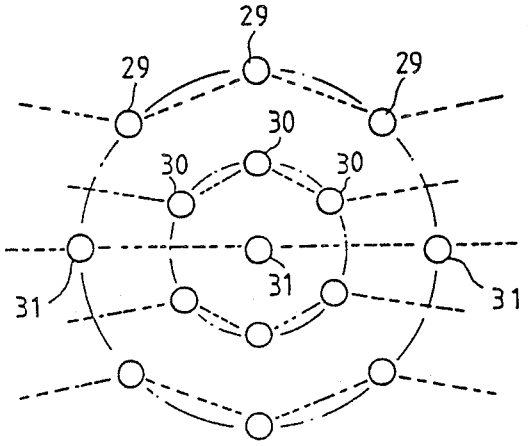
FIG. 5 a similar view with another bristle article.

The apparatus shown in FIGS. 1 to 3 has a draw-in tool 20 which, in the represented embodiment, comprises a guide part 21 with a guide 23 (FIG. 2) for a clamping tool 22 arranged in the median longitudinal plane, said tool being displaceable with respect to guide part 21. In the draw-in tool 20 are provided a successive row of draw-in openings 24, which can have random cross-sectional shapes as a function of the desired cross-sectional shape of the bundle, but in general are circular. If it is a question of producing bristle articles with linear bristle rows, as is e.g. indicated in FIG. 4 by means of rows 25 to 27, then the draw-in openings 24 are arranged in a corresponding linear row, their reciprocal spacing corresponding to the spacing of the individual bundles 28 (FIG. 4) on the finished bristle article. However, if the bristle coverage of the finished bristle article does not have linear rows of bristle bundles, then they are arranged in the form of concentric circles e.g. on a circular support. Thus, e.g. rows can be formed from bristle bundles 29, 30 or 31, which are located on a multiply bent line and then the draw-in openings 24 on draw-in tool 20 are arranged on a corresponding line.

On its top the guide part of the draw-in tool 20 has a channel 32, which receives a correspondingly long bristle section 33. In the represented embodiment, the bristle section 33 is drawn from the endless strand 34 wound onto a roll 35, via guide sleeve 36 into channel 32 by means of a not shown removal device.

Above channel 32 of draw-in tool 20 are arranged in spaced successive manner drawing tools in a number corresponding to the number of draw-in openings. In the represented embodiment, the drawing tools 37 have tongue-like rams 38, which are moveable in the direction of double arrow 39. The tongue-like rams 38 are provided on their underside with a contour 40 (FIG. 2), which roughly corresponds to the upper contour of the bristle section in channel 32.

After the end 41 of bristle section 33 has been drawn behind the last draw-in opening 24 in the drawing or pulling direction, then end 41 is fixed at 42, e.g. by means of a not shown clamping mechanism. The drawing tools 37 then come into operation, in that they are moved downwards and after meeting the bristle section 33 drawn into channel 32 draw same into the draw-in opening 24 and shape same into a loop 43. Shaping takes place at the last opening, which is adjacent to end 41 of bristle section 33 and progresses from there in the direction of positions 1 to 11 until finally all the loops 43 are formed, the necessary length being in each case drawn from the endless strand 34 on roll 35.

The loops 43 are drawn so far into the draw-in openings 24 until their camber 44 projects over the underside of the draw-in tool 20. Below the latter a device 45 is provided for fixing the loops 43 in the vicinity of their camber 44 to the bristle carrier 46. The device shown in FIG. 1 uses a welding or joining process. It has a heating reflector 47, by means of whose top surface 48 the loops 43 can be melted in the vicinity of their camber 44, so that the individual bristles are welded together and optionally form a spherical thickened portion. The bristle carrier 46 is moved up to the other end of the heating reflector 47. At this side the heating reflector 47 has several cam-like protuberances 49, which correspond to the arrangement of the subsequent bristle bundles on the bristle article. By means of the heated cams 49, depressions can be shaped onto the bristle carrier 46 by melting. On moving away the heating reflector 47 the bristle carrier 46 is pressed onto the optionally still soft plastic melted ends of the loops, until the melt has solidified to such an extent that the bristle carrier and bristle bundles are firmly interconnected.

Cutting mechanisms 50 can be arranged above the draw-in tool 20 so as to act between the tongue-like rams 38, said mechanism serving to cut the bristle section 33 between the loops 43, so that the free ends formed can be combined with the loops to form a bundle. If desired, the bundles can be subsequently cut. Instead of this, it is also possible to completely cut off the bristle section 33 by means of a knife moving on the top of the draw-in tool 20 in channel 32 and above said top surface, so that the free ends terminate roughly flush with the draw-in openings 24.

In the embodiment according to FIG. 1, in which the bristle bundles are parallel to one another and at right angles to the bristle carrier on the finished bristle article, the draw-in openings 24 are arranged in a corresponding parallel position. However, numerous implements exist, in which the bristle bundles are at different angles to the top of the bristle carrier. As can be gathered from FIG. 3, in this case the loops 51 are produced in a corresponding angular position, in that the draw-in tool 20 has draw-in openings 52 arranged in a corresponding angular position. As shown in FIG. 3, in this case the drawing tools 53 are also inclined in a corresponding angular position and always aligned with one of the draw-in openings. Operation is fundamentally the same as that of the apparatus according to FIG. 1.

In place of the device constructed as a heating reflector in FIGS. 1 to 3 for fixing the loops 43 or 51 to the bristle carrier 46, the loops can also be mechanically fixed to the latter, e.g. in connection with loop formation the loops can be introduced into correspondingly prepared holes on said carrier 46 and can be optionally fixed by means of an anchor engaging behind the loop camber, or by wedging, adding adhesive, etc. It is also possible to construct device 45 as part of an injection moulding mould or a foaming mould, whose cavity is closed from the underside of the draw-in tool 20. The camber 44 can either be directly embedded in the material injected into the mould, or can be previously melted and only then embedded. In such cases it is naturally advantageous to provide a greater projection of the camber on the underside of the draw-in tool 20 than that shown in FIGS. 1 and 3.

If there are several juxtaposed rows of bristles, then in each of the positions shown in FIGS. 1 and 3, it is possible to provide a corresponding number of synchronously driven drawing tools 37, so that simultaneously the loops 43 are formed for all the bristles at right angles to the rows.

Figure 6:
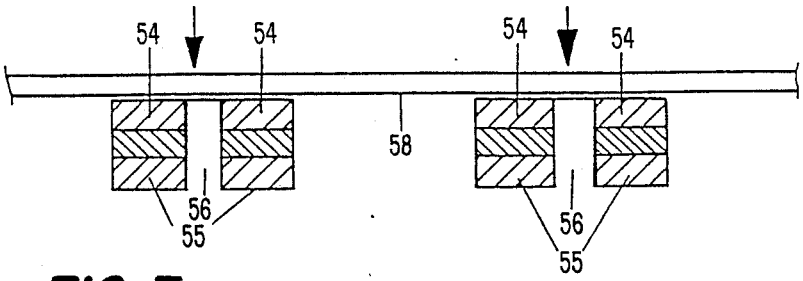
FIG. 6 a diagrammatic view of a third embodiment of the apparatus in the basic position.
Figure 7:
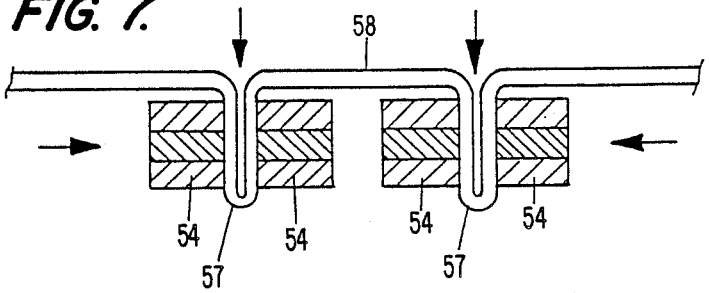
FIG. 7 a view corresponding to FIG. 6 in the end position.

In the apparatus according to FIGS. 6 and 7 the draw-in tool 20 comprises a plurality of ledges 54 arranged at right angles to the bristle row or to the bristle section 33, which are displaceable in the direction of the latter. They are in each case combined in pairs and the ledges of each pair 55 can be moved together from a basic position shown in FIG. 6, where they form between them a relatively wide draw-in opening 56, into an end position (FIG. 7), where their spacing roughly corresponds to the width of the loop 57 to be produced. Simultaneously the pairs 55 of ledges 54 can be moved together, whilst reducing their reciprocal spacing. In the basic position, the drawing tools are aligned with the draw-in openings 56 and are moved up in accordance with their spacing reduction until they reach the end position according to FIG. 7 and simultaneously perform their working stroke. In this way the bristles or bundles of a row can be simultaneously shaped. The length required on drawing in loops 57 is satisfied by the bristle section 58 and namely on the one hand from the length bridging the ledges 54 on a pair 55 and on the other hand during the displacement of the ledge pairs by the length of the bristle section bridging the facing ledges.

Figure 8:
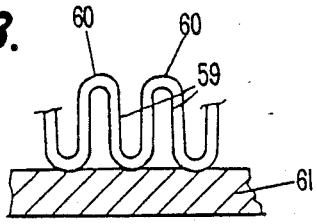
FIG. 8 a detail of an embodiment of the finished bristle article.

As has already been stated, there is no need to cut the loops on their useful side end instead, as shown in FIG. 8, the camber 60 formed on moulding or shaping the loops 59 can be retained on the side facing the bristle carrier 61. In this case the draw-in tool must be open to at least one side or split along the draw-in openings, in order to permit mould removal of loops 59.

Figure 9:
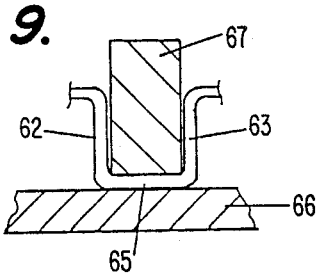
FIG. 9 a detail of another embodiment of the finished bristle article.
Figure 10:
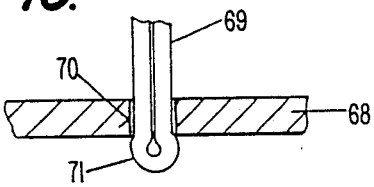
FIG. 10 a detail of a third embodiment of the finished bristle article.

The loops can also be moulded or shaped in such a way that both portions 62,63 of each loop 65 in each case form a bristle bundle, as shown in FIG. 9. In this case, the loop with its camber, which bridges the distance between two bristle bundles, is fixed to the bristle carrier 66. The width of the drawing tool 67 in this case is such that it corresponds to the shortest spacing of the bristle bundles, whilst the width of the draw-in opening roughly corresponds to the maximum spacing of said bundles.

In the simplest construction and as shown in FIG. 1, the bristle carrier 68 can comprise a perforated plate, the camber of a loop 69 being drawn to such an extent into a hole 70, that the camber 71 can widen behind the perforated plate as a result of the recovery capacity and in this way the bundle is held in the removal direction. For addition fixing purposes, a plate-like abutment can be mounted on the back of the perforated plate.

What is claimed is:

1. In a process for producing bristle articles such as brushes, brooms, paintbrushes, combs, and mats comprising combining a bristle carrier and bristles, optionally combined into bundles and connected thereto, in spaced manner in at least one row, a bristle section is shaped by means of a drawing tool to a double layer whilst forming a loop and the loop is fixed by one of its ends to the bristle carrier, the improvement comprising said bristle section is drawn from an endless strand wound onto a roll in a length corresponding to the length required for all the bristles of a row, plus a length resulting from the sum of the spacing of the bristles of a row, the length is then secured at its free end and all the loops in the row are drawn from the bristle section, accompanied by removing the necessary length from the roll and finally simultaneously fixing all of the loops by one of their ends to the bristle carrier.

2. A process according to claim 1, wherein each loop is drawn in a width corresponding to the spacing of adjacent bristles in a row.

3. A process according to claim 2, wherein the loops are cut on their camber formed during drawing.

4. A process according to claim 1 or 2, wherein from the bristle section is initially drawn a first loop accompanied by corresponding shortening of the bristles section and then in a spacing roughly corresponding to the spacing of the bristles in the row the next and successively all the other loops are formed, accompanied by the drawing of the in each case necessary bristle length from the section.

5. A process according to claim 1, wherein the first loop is drawn from the roll in the vicinity of the secured free end of the endless strand and whilst removing the required length and then successively the other loops are formed in the direction of the roll, accompanied by the removal of the necessary length from it.

6. A process according to claim 1 or 5 wherein the section formed into loops is in each case cut between the loops and the resulting ends are joined to the carrier.

7. A process according to claim 1, wherein the loops are cut on their end opposite to the fastening-side end.

8. A process according to claim 1, wherein the loops are connected to the carrier at their camber formed during drawing and the section formed into loops is in each case cut between the loops.

9. A process according to claim 1, wherein the loops are drawn in a parallel position to one another.

10. A process according to claim 1, wherein the loops are drawn in an angular position to one another corresponding to the angular position of the bristles on the finished bristle article.

11. A process according to claim 1, wherein in the case of linear bristle rows a linear bristle section is unwound from the roll.

12. A process according to claim 1, wherein in the case of bristles displaced in the row the bristle section is unwound from the roll.

13. A process according to claim 1, wherein there are three juxtaposed working planes and in the central working plane the loops are formed, whilst alternately the bristle section is produced in the necessary length in one of the other two planes and is brought into the central plane after joining the bristles to the carrier.

14. A process according to claim 1, wherein in the case of a bristle article with several rows of bristles, a corresponding number of bristle sections is unwound from the roll and then at least the loops for all the bristles aligned at right angles to the rows are drawn simultaneously.

15. A process according to claim 1, wherein the loops optionally cut on one of their ends are mechanically fixed to the carrier in holes thereof or fixed by melting the bristle-side surface of the bristle carrier at least at the bristle fixing points and pressing the melted bristle ends optionally also melted against the carrier or by embedding the bristle ends when producing the carrier by injection molding or foaming.

16. A process according to claim 15, wherein the melted bristle ends have a thickened portion or are provided with such and are fixed by it to the carrier.

17. The process according to claim 1 wherein said bristles textile strips or threads fixed to a carrier are in the form of.

18. An apparatus for producing bristle articles comprising a bristle draw-in tool having on its top surface a receptacle for a bristle section and at least one draw-in opening at right angles thereto and with a drawing tool aligned with a draw-in opening and movable in this direction, which covers the bristle section located in the receptacle, draws it into the draw-in opening in double layer for forming a loop until the camber of the loop projects over the facing side of the draw-in tool and with a device for joining the loop to a bristle carrier wherein the draw-in tool has a plurality of draw-in openings, which are arranged in series and in a spacing corresponding to the spacing of the bristles on the finished bristle article and have a receptacle for a corresponding long bristle section engaging over all the draw-in openings and wherein a number of drawing tools corresponding to the number of and aligned with the draw-in openings is provided.

19. An apparatus according to claim 18, wherein the drawing tools simultaneously or in time succeeding manner in the sequence of their arrangement draw the loops into the draw-in openings, whilst providing a corresponding length of the bristle section.

20. An apparatus according to claim 18, wherein the draw-in tool has a guide for a clamping tool with corresponding draw-in openings arranged in its median longitudinal plane and wherein the clamping tool is displaceable in the guide.

21. An apparatus according to claim 18, wherein the draw-in tool is constructed as a rigid plate and the draw-in openings have a cross-section corresponding to the bristles or bundles to be formed.

22. An apparatus according to claim 18, wherein the drawing tool has a width roughly corresponding to the shortest spacing between adjacent bristles and the draw-in openings have a width corresponding to said width, plus twice the width of the bristles or a bundle.

23. An apparatus according to claim 18, wherein the draw-in tool comprises ledges at right angles to the bristle section, whereof in each case two form a draw-in opening and can be moved together from a basic position with a spacing which is greater than the width of the loops synchronously with the movement of the drawing tools, into a position where its spacing corresponds to the width of the loops and simultaneously the pairs of ledges forming in each case one draw-in opening are synchronously movable together, whilst reducing their reciprocal spacing until in their end position the spacing of the draw-in openings formed by them corresponds to the spacing of the bristles, whilst at the same time the drawing tools are moved at right angles to one another.

24. An apparatus according to claim 18, wherein the receptacle for the bristle section is constructed as a channel arranged on the top of the draw-in tool (20) and its width roughly corresponds to the diameter of the bristle section.

25. An apparatus according to claim 18, wherein said draw-in tool is associated with a roll containing the bristles as an endless strand and a removal device, by means of which a bristle section can be drawn into a channel to such an extent that the free end is located behind the final draw-in opening in the removal direction, wherein there is a holding device for fixing the free end and wherein initially the drawing tool close to the free end and then the other tools succeeding it in the direction of the roll come into action and the length in each case required for a loop is drawn from the roll counter to an opposing force keeping the bristle section taut, whilst between roll and the first draw-in opening is provided a cutting mechanism which comes into operation at the end of loop formation.

26. An apparatus according to claim 18, wherein a channel of the draw-in tool receives a bristle section in the form of a blank, whose length roughly corresponds to twice the length of all the loops, plus the sum of all the spacings between the loops, wherein upstream of the first and downstream of the last draw-in opening is provided a holding down device for the bristle blank and wherein the drawing tools, starting at the first or last draw-in opening pass in the direction of in each case other opening, or starting in the centre simultaneously operate to either side.

27. An apparatus according to claim 18, wherein, above the draw-in tool is provided a cutting mechanism for separating the bristle section at the start of the loops or between them.

28. An apparatus according to claim 18, wherein, below the draw-in too, is provided a cutting mechanism for separating the loops on the camber projecting over the draw-in tool.

29. An apparatus according to claim 18, wherein the device for joining the loops to the bristle carrier is positioned immediately below the draw-in tool.

30. An apparatus according to claim 18, wherein the draw-in tool with the draw-in loops is moved up to the device spatially separated from it for joining the loops to the bristle carrier and wherein several draw-in tools are provided, which are movable between the loop formation point and the joining device.

31. An apparatus according to claim 18, wherein there are at least two draw-in tools or one draw-in tool with two parallel rows of draw-in openings and the drawing tools are only associated with one row of such openings, whereas in the case of the other row of openings, only the bristle section is placed in a channel and wherein the draw-in tool is movable at right angles to the row of drawing tools into in each case one position beside the same for inserting the bristle section during the loop formation in the central position.

32. An apparatus according to claim 18, wherein with each row of draw-in openings is associated a roll with a bristle endless strand and the rolls can be moved with the draw-in tool.

33. An apparatus according to claim 18, wherein the draw-in openings are parallel to one another.

34. An apparatus according to claim 18, wherein the draw-in openings are arranged at an angle to one another corresponding to the angular positions of the bristles on the finished bristle article.

35. An apparatus according to claim 18, wherein the draw-in openings are arranged on a line following the arrangement of the bristles on the bristle article.

36. An apparatus according to claim 18, wherein the drawing tools are arranged above the draw-in tool and are constructed as tongues movable from top to bottom.

37. An apparatus according to claim 18, wherein the drawing tools are constructed in crotchet needle-like manner, are arranged below the drawing tool and can be moved from a position above the same into a position below it.

38. An apparatus according to claim 18, wherein a draw-in tool has a number of rows of draw-in openings corresponding to the number of bristle rows of the finished bristle article or part thereof, a corresponding number of drawing tool rows is provided and the drawing tools aligned at right angle to the rows are driven synchronously or arranged on a common carrier.

* * * * *